US007450091B2

(12) United States Patent
Kao et al.

(10) Patent No.: US 7,450,091 B2
(45) Date of Patent: Nov. 11, 2008

(54) APPARATUS AND METHOD FOR ADJUSTING GRAY LEVELS IN DISPLAY DEVICE

(75) Inventors: Hsu-Pin Kao, Pingjen (TW); Hsu-Chia Kao, Pingjen (TW); Yi-Chia Shan, Chungli (TW); Yi-Sheng Yu, Taoyuan (TW)

(73) Assignee: Quanta Computer Inc., Tao Yuan Shien (TW)

( * ) Notice: Subject to any disclaimer, the term of this patent is extended or adjusted under 35 U.S.C. 154(b) by 696 days.

(21) Appl. No.: 11/098,102

(22) Filed: Apr. 4, 2005

(65) Prior Publication Data

US 2005/0248506 A1 Nov. 10, 2005

(30) Foreign Application Priority Data

May 7, 2004 (TW) ..... 93113006 A

(51) Int. Cl.
*G09G 3/28* (2006.01)

(52) U.S. Cl. ..... 345/63; 345/690

(58) Field of Classification Search ..... 345/63, 345/77, 89, 204, 690
See application file for complete search history.

(56) References Cited

U.S. PATENT DOCUMENTS

| | | | | |
|---|---|---|---|---|
| 5,546,476 | A | 8/1996 | Mitaka et al. | |
| 5,859,921 | A | 1/1999 | Suzuki | |
| 6,069,609 | A * | 5/2000 | Ishida et al. | 345/596 |
| 7,025,252 | B2 * | 4/2006 | Kim | 234/63 |
| 7,088,316 | B2 * | 8/2006 | Kao et al. | 345/72 |
| 7,239,740 | B1 | 7/2007 | Fujieda | |
| 2002/0036650 | A1 * | 3/2002 | Kasahara et al. | 345/639 |
| 2002/0054000 | A1 * | 5/2002 | Tokunaga et al. | 345/60 |
| 2002/0135595 | A1 * | 9/2002 | Morita et al. | 345/589 |

FOREIGN PATENT DOCUMENTS

| | | | |
|---|---|---|---|
| CN | 1487490 | A | 4/2004 |
| JP | 6118920 | A | 4/1994 |
| JP | 2000276100 | A | 10/2000 |
| JP | 2001117528 | A | 4/2001 |
| JP | 2001154630 | A | 6/2001 |
| JP | 2002149106 | A | 5/2002 |
| JP | 2003195801 | A | 7/2003 |
| JP | 2003302955 | A | 10/2003 |
| JP | 2003330420 | A | 11/2003 |

* cited by examiner

*Primary Examiner*—Chanh Nguyen
*Assistant Examiner*—Bao-Quan T Ho
(74) *Attorney, Agent, or Firm*—Hoffman Warnick LLC

(57) ABSTRACT

The invention discloses an apparatus for increasing the display gray levels. The apparatus includes a signal transformation circuit, an error diffusion circuit, and an operation circuit. According to a first predetermined manner, the signal transformation circuit transforms a set of image signals into a set of transformed signals. The error diffusion circuit receives the set of transformed signals and generates a set of diffused signals according to a judging rule. The operation circuit receives the set of diffused signals and generates a set of output image signals according to a second predetermined manner and a predetermined operational rule.

10 Claims, 15 Drawing Sheets

41

| 42 Gray levels of 8 bits | 44 Gray levels after gamma of 2.2 | 46 Gray levels displayed by an 8 bits PDP |
|---|---|---|
| 1 | 0.001295 | 0 |
| 2 | 0.005949 | 0 |
| 3 | 0.014515 | 0 |
| : | : | : |
| 21 | 1.049625 | 1 |
| 22 | 1.162738 | 1 |
| : | : | : |
| 29 | 2.135145 | 2 |
| 30 | 2.30048 | 2 |
| : | : | : |
| : | : | : |
| 43 | 5.079049 | 5 |
| 44 | 5.342539 | 5 |
| 45 | 5.613314 | 5 |
| : | : | : |
| 255 | 255 | 255 |
| Total: 256 | Total : 256 | Total : 184 |

FIG. 3

51

| 52 Diffused signals | 54 Temporary signals | 56 Mask |
|---|---|---|
| 0 | 0 | × |
| 1 | 1 | Mask A |
| 2 | 1 | Mask B |
| 3 | 1 | Mask C |
| 4 | 1 | × |
| 5 | 2 | Mask A |
| 6 | 2 | Mask B |
| 7 | 2 | Mask C |
| 8 | 2 | × |
| 9 | 3 | Mask A |
| 10 | 3 | Mask B |
| 11 | 3 | Mask C |
| 12 | 3 | × |
| ... | ... | ... |
| 1016 | 254 | Mask A |
| 1017 | 254 | Mask B |
| 1018 | 254 | Mask C |
| 1019 | 254 | × |
| 1020 | 255 | Mask A |
| 1021 | 255 | Mask B |
| 1022 | 255 | Mask C |
| 1023 | 255 | × |

FIG. 4

60

| | | | |
|---|---|---|---|
| A | B | C | D |
| E | F | G | H |
| I | J | K | L |
| M | N | O | P |

62

| | |
|---|---|
| K1 | K2 |
| K3 | K4 |

64

| | | | |
|---|---|---|---|
| A-K1 | B-K2 | C-K1 | D-K2 |
| E-K3 | F-K4 | G-K3 | H-K4 |
| I-K1 | J-K2 | K-K1 | L-K1 |
| M-K3 | N-K4 | O-K3 | P-K4 |

FIG. 5

78

| | | | |
|---|---|---|---|
| A1 | A2 | A3 | A4 |
| A5 | A6 | A7 | A8 |
| A9 | A10 | A11 | A12 |
| A13 | A14 | A15 | A16 |

80

| | | | |
|---|---|---|---|
| 1 | 2 | 3 | 4 |
| 1 | 2 | 3 | 4 |
| 1 | 2 | 3 | 4 |
| 1 | 2 | 3 | 4 |

FIG. 6b

90

| | | | |
|---|---|---|---|
| 0.5 | 1.5 | 2.5 | 3.5 |
| 0.5 | 1.5 | 2.5 | 3.5 |
| 0.5 | 1.5 | 2.5 | 3.5 |
| 0.5 | 1.5 | 2.5 | 3.5 |

FIG. 6d

| | | | |
|---|---|---|---|
| 0 | 1 | 1 | 1 |
| 1 | 1 | 0 | 1 |
| 1 | 0 | 1 | 1 |
| 1 | 1 | 1 | 0 |

| | | | |
|---|---|---|---|
| 1 | 1 | 1 | 1 |
| 1 | 0 | 1 | 0 |
| 0 | 1 | 1 | 1 |
| 1 | 1 | 0 | 1 |

| | | | |
|---|---|---|---|
| 1 | 1 | 1 | 0 |
| 1 | 0 | 1 | 1 |
| 0 | 1 | 1 | 1 |
| 1 | 1 | 0 | 1 |

| | | | |
|---|---|---|---|
| 1 | 1 | 1 | 0 |
| 1 | 0 | 1 | 1 |
| 0 | 1 | 1 | 1 |
| 1 | 1 | 0 | 1 |

FIG. 7a

| | | | |
|---|---|---|---|
| 1 | 0 | 1 | 0 |
| 0 | 1 | 0 | 1 |
| 1 | 0 | 1 | 0 |
| 0 | 1 | 0 | 1 |

| | | | |
|---|---|---|---|
| 0 | 1 | 0 | 1 |
| 1 | 0 | 1 | 0 |
| 0 | 1 | 0 | 1 |
| 1 | 0 | 1 | 1 |

| | | | |
|---|---|---|---|
| 0 | 1 | 0 | 1 |
| 1 | 0 | 1 | 0 |
| 0 | 1 | 0 | 0 |
| 1 | 0 | 1 | 1 |

| | | | |
|---|---|---|---|
| 1 | 0 | 1 | 1 |
| 0 | 1 | 0 | 0 |
| 1 | 0 | 1 | 1 |
| 0 | 1 | 0 | 0 |

FIG. 7b

| Gray/ Y-with | | | | | | | | | | | | | | | |
|---|---|---|---|---|---|---|---|---|---|---|---|---|---|---|---|
| 0 | 0.20 | 32 | 0.21 | 64 | 1.02 | 96 | 3.79 | 128 | 10.34 | 160 | 22.74 | 192 | 41.70 | 224 | 68.69 |
| 1 | 0.20 | 33 | 0.21 | 65 | 1.07 | 97 | 4.01 | 129 | 10.62 | 161 | 23.35 | 193 | 42.44 | 225 | 69.47 |
| 2 | 0.20 | 34 | 0.22 | 66 | 1.14 | 98 | 4.17 | 130 | 10.96 | 162 | 23.87 | 194 | 43.03 | 226 | 70.45 |
| 3 | 0.20 | 35 | 0.25 | 67 | 1.23 | 99 | 4.26 | 131 | 11.26 | 163 | 24.14 | 195 | 43.97 | 227 | 71.34 |
| 4 | 0.20 | 36 | 0.29 | 68 | 1.27 | 100 | 4.39 | 132 | 11.49 | 164 | 24.68 | 196 | 44.61 | 228 | 72.05 |
| 5 | 0.20 | 37 | 0.31 | 69 | 1.30 | 101 | 4.52 | 133 | 11.90 | 165 | 25.16 | 197 | 45.17 | 229 | 73.17 |
| 6 | 0.20 | 38 | 0.31 | 70 | 1.37 | 102 | 4.69 | 134 | 12.24 | 166 | 25.71 | 198 | 45.97 | 230 | 74.13 |
| 7 | 0.20 | 39 | 0.31 | 71 | 1.46 | 103 | 4.92 | 135 | 12.63 | 167 | 26.29 | 199 | 47.37 | 231 | 75.06 |
| 8 | 0.20 | 40 | 0.31 | 72 | 1.51 | 104 | 5.08 | 136 | 12.92 | 168 | 26.77 | 200 | 48.75 | 232 | 75.95 |
| 9 | 0.20 | 41 | 0.33 | 73 | 1.56 | 105 | 5.22 | 137 | 13.27 | 169 | 27.31 | 201 | 49.35 | 233 | 76.99 |
| 10 | 0.20 | 42 | 0.35 | 74 | 1.65 | 106 | 5.40 | 138 | 13.49 | 170 | 28.07 | 202 | 49.97 | 234 | 78.86 |
| 11 | 0.20 | 43 | 0.36 | 75 | 1.73 | 107 | 5.57 | 139 | 13.74 | 171 | 28.77 | 203 | 50.79 | 235 | 79.83 |
| 12 | 0.20 | 44 | 0.36 | 76 | 1.77 | 108 | 5.80 | 140 | 14.15 | 172 | 29.13 | 204 | 51.54 | 236 | 80.76 |
| 13 | 0.20 | 45 | 0.36 | 77 | 1.81 | 109 | 5.92 | 141 | 14.52 | 173 | 29.74 | 205 | 52.29 | 237 | 81.85 |
| 14 | 0.20 | 46 | 0.39 | 78 | 1.87 | 110 | 6.13 | 142 | 14.81 | 174 | 30.31 | 206 | 52.83 | 238 | 82.91 |
| 15 | 0.20 | 47 | 0.42 | 79 | 1.94 | 111 | 6.29 | 143 | 15.37 | 175 | 30.97 | 207 | 54.00 | 239 | 83.80 |
| 16 | 0.20 | 48 | 0.44 | 80 | 2.06 | 112 | 6.49 | 144 | 15.73 | 176 | 31.66 | 208 | 54.65 | 240 | 85.25 |
| 17 | 0.20 | 49 | 0.45 | 81 | 2.18 | 113 | 6.69 | 145 | 15.92 | 177 | 32.26 | 209 | 55.61 | 241 | 86.16 |
| 18 | 0.20 | 50 | 0.46 | 82 | 2.30 | 114 | 6.93 | 146 | 16.42 | 178 | 32.45 | 210 | 56.18 | 242 | 87.07 |
| 19 | 0.20 | 51 | 0.52 | 83 | 2.40 | 115 | 7.11 | 147 | 16.90 | 179 | 33.32 | 211 | 56.80 | 243 | 87.77 |
| 20 | 0.20 | 52 | 0.59 | 84 | 2.50 | 116 | 7.38 | 148 | 17.34 | 180 | 33.67 | 212 | 57.66 | 244 | 88.78 |
| 21 | 0.20 | 53 | 0.63 | 85 | 2.61 | 117 | 7.61 | 149 | 17.74 | 181 | 34.00 | 213 | 58.64 | 245 | 89.73 |
| 22 | 0.20 | 54 | 0.64 | 86 | 2.70 | 118 | 7.83 | 150 | 18.34 | 182 | 35.20 | 214 | 59.89 | 246 | 90.39 |
| 23 | 0.20 | 55 | 0.66 | 87 | 2.77 | 119 | 8.09 | 151 | 18.66 | 183 | 35.86 | 215 | 60.94 | 247 | 91.41 |
| 24 | 0.20 | 56 | 0.70 | 88 | 2.85 | 120 | 8.31 | 152 | 19.07 | 184 | 36.47 | 216 | 62.02 | 248 | 92.86 |
| 25 | 0.20 | 57 | 0.75 | 89 | 2.93 | 121 | 8.57 | 153 | 19.49 | 185 | 37.11 | 217 | 62.75 | 249 | 93.99 |
| 26 | 0.20 | 58 | 0.74 | 90 | 3.03 | 122 | 8.83 | 154 | 19.97 | 186 | 37.93 | 218 | 63.29 | 250 | 94.63 |
| 27 | 0.20 | 59 | 0.77 | 91 | 3.19 | 123 | 9.01 | 155 | 20.47 | 187 | 38.34 | 219 | 64.15 | 251 | 95.45 |
| 28 | 0.20 | 60 | 0.86 | 92 | 3.37 | 124 | 9.30 | 156 | 20.88 | 188 | 38.96 | 220 | 65.07 | 252 | 96.35 |
| 29 | 0.20 | 61 | 0.95 | 93 | 3.46 | 125 | 9.54 | 157 | 21.38 | 189 | 39.59 | 221 | 65.98 | 253 | 97.51 |
| 30 | 0.20 | 62 | 0.98 | 94 | 3.59 | 126 | 9.90 | 158 | 21.89 | 190 | 40.55 | 222 | 67.01 | 254 | 98.54 |
| 31 | 0.21 | 63 | 0.98 | 95 | 3.72 | 127 | 10.20 | 159 | 22.37 | 191 | 41.11 | 223 | 67.62 | 255 | 99.45 |

FIG. 9A

| Gray/Y-without | | | | | | | | | | | | | | | |
|---|---|---|---|---|---|---|---|---|---|---|---|---|---|---|---|
| 0 | 0.20 | 32 | 0.21 | 64 | 1.10 | 96 | 3.80 | 128 | 10.36 | 160 | 22.71 | 192 | 41.81 | 224 | 68.61 |
| 1 | 0.20 | 33 | 0.21 | 65 | 1.10 | 97 | 4.02 | 129 | 10.72 | 161 | 23.33 | 193 | 42.50 | 225 | 69.28 |
| 2 | 0.20 | 34 | 0.31 | 66 | 1.26 | 98 | 4.24 | 130 | 10.97 | 162 | 23.94 | 194 | 43.01 | 226 | 70.58 |
| 3 | 0.20 | 35 | 0.31 | 67 | 1.27 | 99 | 4.27 | 131 | 11.20 | 163 | 24.19 | 195 | 43.94 | 227 | 71.19 |
| 4 | 0.20 | 36 | 0.31 | 68 | 1.26 | 100 | 4.47 | 132 | 11.50 | 164 | 24.65 | 196 | 44.43 | 228 | 72.12 |
| 5 | 0.20 | 37 | 0.31 | 69 | 1.32 | 101 | 4.58 | 133 | 11.83 | 165 | 25.15 | 197 | 45.28 | 229 | 73.02 |
| 6 | 0.20 | 38 | 0.31 | 70 | 1.46 | 102 | 4.87 | 134 | 12.19 | 166 | 25.88 | 198 | 45.97 | 230 | 74.03 |
| 7 | 0.20 | 39 | 0.31 | 71 | 1.47 | 103 | 4.97 | 135 | 12.45 | 167 | 26.28 | 199 | 47.32 | 231 | 75.17 |
| 8 | 0.20 | 40 | 0.36 | 72 | 1.53 | 104 | 5.06 | 136 | 12.84 | 168 | 26.66 | 200 | 48.89 | 232 | 76.06 |
| 9 | 0.20 | 41 | 0.36 | 73 | 1.58 | 105 | 5.32 | 137 | 13.18 | 169 | 27.37 | 201 | 49.31 | 233 | 77.22 |
| 10 | 0.20 | 42 | 0.36 | 74 | 1.73 | 106 | 5.45 | 138 | 13.43 | 170 | 28.31 | 202 | 50.11 | 234 | 78.51 |
| 11 | 0.20 | 43 | 0.37 | 75 | 1.73 | 107 | 5.75 | 139 | 13.78 | 171 | 28.79 | 203 | 50.72 | 235 | 79.23 |
| 12 | 0.20 | 44 | 0.37 | 76 | 1.79 | 108 | 5.84 | 140 | 14.07 | 172 | 29.12 | 204 | 51.72 | 236 | 80.62 |
| 13 | 0.20 | 45 | 0.37 | 77 | 1.87 | 109 | 5.91 | 141 | 14.46 | 173 | 29.87 | 205 | 51.93 | 237 | 81.92 |
| 14 | 0.20 | 46 | 0.44 | 78 | 1.89 | 110 | 6.19 | 142 | 14.87 | 174 | 30.36 | 206 | 53.08 | 238 | 82.71 |
| 15 | 0.20 | 47 | 0.44 | 79 | 2.01 | 111 | 6.35 | 143 | 15.66 | 175 | 30.79 | 207 | 54.11 | 239 | 83.55 |
| 16 | 0.20 | 48 | 0.44 | 80 | 2.18 | 112 | 6.58 | 144 | 15.66 | 176 | 31.69 | 208 | 54.38 | 240 | 84.90 |
| 17 | 0.20 | 49 | 0.46 | 81 | 2.21 | 113 | 6.87 | 145 | 16.13 | 177 | 32.07 | 209 | 55.69 | 241 | 85.94 |
| 18 | 0.20 | 50 | 0.46 | 82 | 2.40 | 114 | 7.00 | 146 | 16.51 | 178 | 32.50 | 210 | 56.14 | 242 | 86.94 |
| 19 | 0.20 | 51 | 0.62 | 83 | 2.41 | 115 | 7.11 | 147 | 16.91 | 179 | 33.44 | 211 | 56.69 | 243 | 87.67 |
| 20 | 0.20 | 52 | 0.62 | 84 | 2.57 | 116 | 7.41 | 148 | 17.26 | 180 | 33.67 | 212 | 57.80 | 244 | 88.69 |
| 21 | 0.20 | 53 | 0.65 | 85 | 2.70 | 117 | 7.67 | 149 | 17.69 | 181 | 34.48 | 213 | 58.38 | 245 | 89.61 |
| 22 | 0.19 | 54 | 0.65 | 86 | 2.69 | 118 | 7.91 | 150 | 18.37 | 182 | 35.28 | 214 | 59.63 | 246 | 90.31 |
| 23 | 0.19 | 55 | 0.68 | 87 | 2.78 | 119 | 8.08 | 151 | 18.84 | 183 | 35.62 | 215 | 60.94 | 247 | 91.95 |
| 24 | 0.19 | 56 | 0.74 | 88 | 2.93 | 120 | 8.44 | 152 | 19.14 | 184 | 36.39 | 216 | 61.52 | 248 | 93.18 |
| 25 | 0.19 | 57 | 0.74 | 89 | 2.92 | 121 | 8.78 | 153 | 19.56 | 185 | 37.07 | 217 | 62.59 | 249 | 93.99 |
| 26 | 0.19 | 58 | 0.74 | 90 | 3.11 | 122 | 8.91 | 154 | 19.91 | 186 | 37.92 | 218 | 63.33 | 250 | 94.75 |
| 27 | 0.19 | 59 | 0.82 | 91 | 3.36 | 123 | 9.12 | 155 | 20.46 | 187 | 38.38 | 219 | 64.36 | 251 | 95.36 |
| 28 | 0.19 | 60 | 0.98 | 92 | 3.40 | 124 | 9.38 | 156 | 20.95 | 188 | 39.10 | 220 | 64.68 | 252 | 96.41 |
| 29 | 0.21 | 61 | 0.98 | 93 | 3.51 | 125 | 9.64 | 157 | 21.54 | 189 | 39.60 | 221 | 65.85 | 253 | 97.14 |
| 30 | 0.21 | 62 | 0.98 | 94 | 3.68 | 126 | 9.97 | 158 | 22.05 | 190 | 40.60 | 222 | 66.99 | 254 | 98.18 |
| 31 | 0.21 | 63 | 0.98 | 95 | 3.77 | 127 | 10.15 | 159 | 22.42 | 191 | 41.17 | 223 | 67.60 | 255 | 99.19 |

FIG. 9B

APPARATUS AND METHOD FOR ADJUSTING GRAY LEVELS IN DISPLAY DEVICE

FIELD OF THE INVENTION

The invention relates to an apparatus and method applied in a display device for increasing the display gray levels.

DESCRIPTION OF THE PRIOR ART

The conventional flat display device, such as plasma display panel (PDP) module, always displays images with 0~255 gray levels by 8 bits. In other words, the images are displayed with 256 gray levels.

Referring to FIG. 1, FIG. 1 is a schematic diagram illustrating the relation between the gray levels and the brightness of the conventional PDP module. As shown in FIG. 1, the relation between the gray levels and the brightness of the conventional PDP is substantially linear. For example, if the brightness of a module is 512 cd/m2, the brightness gradient of each gray level adjacent to another is 2 cd/m2. In other words, the brightness of the gray level "1" is 2 cd/m2. When the brightness of the module is raised to 1024 cd/m2, the brightness of the gray level "1" will be also raised to 4 cd/m2. However, the image contrast will be influenced once the brightness of the unit gray level has an exceeding value.

Currently, the brightness of the PDP module is getting higher gradually, so the influence caused by the exceeding brightness of the unit gray level is getting more serious. Accordingly, since the conventional PDP module divides the brightness into 256 levels, it will not satisfy future applications.

Because the relation between the gray levels and the brightness of the PDP module is substantially linear, when a user uses the PDP module to watch a movie, it's necessary to correct the image signals via a gamma adjust transformation of 2.2, so that the movie can be performed with correct contrast and colors. In general, each image signal of a movie has 8 bits, and the signal inputted to the PDP module also has 8 bits. When the image signals are transformed by the gamma adjust transformation of 2.2 and then inputted into the PDP module in 8 bits, most of the details of the low gray levels will disappear due to the gamma adjust transformation of 2.2. For instance, if the gray levels of an image originally are distributed over the range of 0~42, the gray levels of the image will be distributed over the range of 0~4 after the gamma adjust transformation of 2.2 is performed for the image.

The conventional error diffusion calculation is generally used for reducing the loss of the details of the low gray levels, but it can't solve the problem that the brightness of the unit gray level has an exceeding value.

Once the brightness of the unit gray level has an exceeding value, there will be the following problems. 1) When a frame is displayed with low brightness, the resolution is worse for a user to watch. 2) When the conventional error diffusion calculation is used to modify the details of the low gray levels, due to the exceeding brightness of the unit gray level, the frame will be displayed unsteadily.

Accordingly, the objective of the invention is to modify the exceeding brightness of the unit gray level and to increase the display gray levels of the display device.

SUMMARY OF THE INVENTION

The objective of the invention is to provide an apparatus for modifying the exceeding brightness of the unit gray level and for increasing the display gray levels of the display device.

According to the invention, the apparatus used for increasing the display gray levels includes a signal transformation circuit, an error diffusion circuit, and an operation circuit. According to a first predetermined manner, the signal transformation circuit is used for transforming a set of image signals into a set of transformed signals. The error diffusion circuit is used for receiving the set of transformed signals and for generating a set of diffused signals according to a judging rule. The operation circuit is used for receiving the set of diffused signals and for generating a set of output image signals according to a second predetermined manner and a predetermined operational rule.

Based on the error diffusion circuit and the operation circuit, the apparatus of the invention can modify the exceeding brightness of the unit gray level and improve the image quality, so as to achieve the objective of increasing the display gray levels. Accordingly, the image will be displayed with a high resolution.

The advantage and spirit of the invention may be understood by the following recitations together with the appended drawings.

BRIEF DESCRIPTION OF THE APPENDED DRAWINGS

FIG. 3 is a schematic diagram illustrating a gamma look up table of the apparatus shown in FIG. 2.

FIG. 4 is a schematic diagram illustrating the first look up table of the apparatus shown in FIG. 2.

FIG. 5 is a schematic diagram illustrating the operating rule according to a preferred embodiment of the invention.

FIG. 6B is a schematic diagram illustrating an image of 4*4 matrix being calculated with the corresponding matrix according to the invention.

FIG. 6D is a schematic diagram illustrating the average brightness of each dot of the four fields shown in FIG. 6C.

FIG. 7A is a schematic diagram illustrating the masks capable of enabling the brightness of an image 0.25 times the original according to the invention.

FIG. 7B is a schematic diagram illustrating the masks capable of enabling the brightness of an image 0.5 times the original brightness according to the invention.

FIG. 9A illustrates the data measured after performing the method of the invention.

FIG. 9B illustrates the data measured without performing the method of the invention.

DETAILED DESCRIPTION OF THE INVENTION

Figure 2:
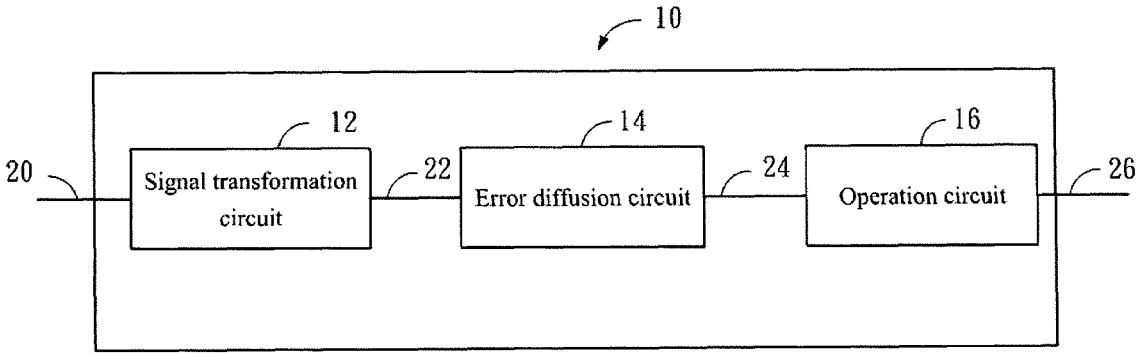
FIG. 2 is a functional block diagram illustrating an apparatus for increasing the display gray levels according to the invention.

Referring to FIG. 2, FIG. 2 is a functional block diagram illustrating an apparatus 10 for increasing the display gray levels according to the invention. The apparatus 10 includes a signal transformation circuit 12, an error diffusion circuit 14, and an operation circuit 16.

According to a first predetermined manner, the signal transformation circuit 12 is used for transforming a set of image signals 20 to a set of transformed signals 22. The error diffusion circuit 14 is used for receiving the set of transformed signals 22 and for generating a set of diffused signals 24 according to a judging rule. The operation circuit 16 is used for receiving the set of diffused signals 24 and for generating a set of output image signals 26 according to a second predetermined manner and a predetermined operational rule.

Referring to FIG. 3, FIG. 3 is a schematic diagram illustrating a gamma look up table 41 of the apparatus 10 shown in FIG. 2. Thereinafter the first predetermined manner is described in detail. The first predetermined manner is to utilize a gamma look up table to transform the set of image signals 20 to the set of transformed signals 22, wherein each of the image signals 20 has L bits, each of the transformed signals 22 has M bits, and M>L. A set of 8 bits image signals 20 is transformed into a set of 12 bits transformed signals 22 by the gamma look up table utilizing a gamma adjust transformation of 2.2, wherein the high bits, i.e. 8 bits, of the 12 bits represent the integral part and the low bits, i.e. 4 bits, of the 12 bits represent the decimal part.

In an embodiment, a gamma look up table 41 is shown in FIG. 3. A set of 8 bits image signals 20 is transformed into a set of 12 bits transformed signals 22 by the gamma look up table 41 utilizing a gamma adjust transformation of 2.2, wherein the high bits, i.e. 8 bits, of the 12 bits represent the integral part and the low bits, i.e. 4 bits, of the 12 bits represent the decimal part. As shown in FIG. 3, the column 42 shows the gray levels of the inputted 8 bits image signals, the column 44 shows the gray levels of the transformed signals after the gamma adjust transformation of 2.2 is performed, and the column 46 shows the gray levels of the 8 bits image signals, which can be displayed by an 8 bits display device. Accordingly, the integral part of the gray level of each 8 bits image signal is shown in the column 46, and the rest of 4 bits represent the decimal part after the gamma adjust transformation of 2.2 is performed (not shown). The gamma look up table 41 can be used to transform a set of 8 bits image signals to a set of 12 bits transformed signals.

Thereinafter the judging rule is described in detail. The judging rule performs an error diffusion calculation for N high bits and remained (M−N) low bits of each of the transformed signals, so as to generate the set of diffused signals 24, and each of the diffused signals 24 has N bits.

In an embodiment, the set of transformed signals 22 is a set of 12 bits signals. The error diffusion circuit 14 utilizes the judging rule to perform the error diffusion calculation for 10 high bits and 2 low bits of each of the transformed signals. Accordingly, the error diffusion circuit 14 will generate a set of 10 bits diffused signals 24.

Thereinafter the second predetermined manner and the predetermined operational rule both are described in detail. The operation circuit 16 utilizes the second predetermined manner to transform the set of diffused signals 24 to a set of temporary signals 25, and, according to the predetermined operational rule and the set of temporary signals 25, generates the set of output image signals 26.

The second predetermined manner is to utilize a first look up table to transform the set of diffused signals 24 into the set of temporary signals 25. Each of the temporary signals 25 has K bits, and N>K.

The predetermined operational rule calculates the set of the temporary signals 25 with a set of masks to generate the set of output image signals 26, and each of the output image signals 26 has K bits.

Each of the masks includes P Q*Q matrixes, wherein Q is greater than or equal to 2. In an embodiment, the set of masks includes a first mask, a second mask, and a third mask, and P and Q respectively represent four. In other words, each mask includes four 4*4 matrixes. The first mask includes four 4*4 matrixes, wherein 1 is the element corresponding to the i-th row and the j-th column in three of the four 4*4 matrixes, 0 is the element corresponding to the i-th row and the j-th column in the rest of the four 4*4 matrixes, and $1 \leqq i \leqq 4$; $1 \leqq j \leqq 4$. The second mask includes four 4*4 matrixes, wherein 1 is the element corresponding to the i-th row and the j-th column in two of the four 4*4 matrixes, 0 is the element corresponding to the i-th row and the j-th column in the rest of the four 4*4 matrixes, and $1 \leqq i \leqq 4$; $1 \leqq j \leqq 4$. The third mask includes four 4*4 matrixes, wherein 1 is the element corresponding to the i-th row and the j-th column in one of the four 4*4 matrixes, 0 is the element corresponding to the i-th row and the j-th column in the rest of the four 4*4 matrixes, and $1 \leqq i \leqq 4$; $1 \leqq j \leqq 4$.

Figure 1:
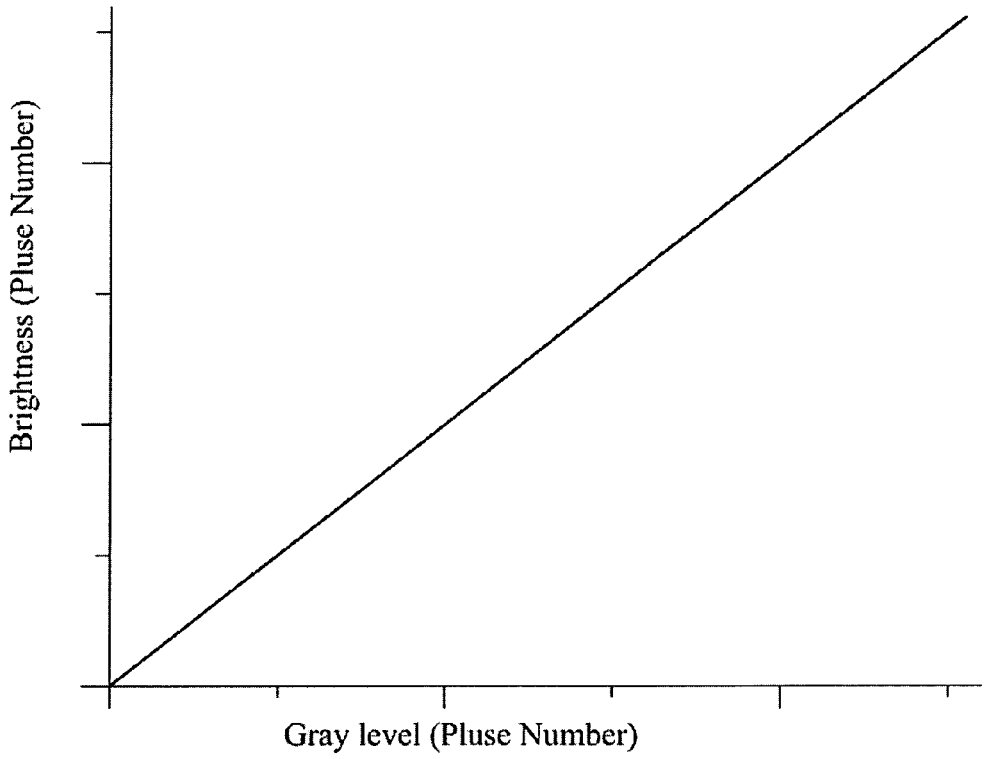
FIG. 1 (Prior art)
FIG. 1 is a schematic diagram illustrating the relation between the gray levels and the brightness of the conventional PDP module.

Referring to the FIG. 4, FIG. 4 is a schematic diagram illustrating the first look up table 51 of the apparatus 10 showing in FIG. 1. In an embodiment, the first look up table 51 includes three columns, wherein the column 52 shows the gray levels of the diffused signals, the column 54 shows the gray levels of the temporary signals, and the column 56 shows the corresponding predetermined operational rule. In this embodiment, each of the diffused signals has 10 bits, each of the temporary signals has 8 bits, and each of the gray levels of the input image signals respectively corresponds to a predetermined operational rule. As shown in FIG. 4, the predetermined operational rule corresponding to the gray levels 1, 5, 9, . . . , 1016, 1020 is the mask A, the predetermined operational rule corresponding to the gray levels 2, 6, 10, . . . , 1017, 1021 is the mask B, and the predetermined operational rule corresponding to the gray levels 3, 7, 11, . . . , 1018, 1022 is the mask C. The brightness of an image is 0.25 times the original brightness through the mask A, the brightness of an image is 0.5 times the original brightness through the mask B, and the brightness of an image is 0.75 times the original brightness through the mask C. Therefore, by the first look up table 51, the gray level of a 10 bits diffused signals can be transformed into the gray level of an 8 bits temporary signals, and a corresponding predetermined operational rule can be also obtained.

According to the invention, the apparatus for increasing the display gray levels has a set of masks capable of changing with different span of time. When an image is calculated by the masks before being outputted, the brightness is variable based on different span of time. In the system of NTSC, there are 60 images per second, wherein the 1st, 5th, 9th, 13th, . . . , and 57th images belong to field I, the 2nd, 6th, 10th, 14th, . . . , and 58th images belong to field II, the 3rd, 7th, 11th, 15th, . . . , and 59th images belong to field III, and the 4th, 8th, 12th, 16th, . . . , 60th images belong to field IV. The four fields I, II, III, and IV respectively correspond to four masks, and the images of each field are respectively calculated by the corresponding mask.

Referring to FIG. 5, FIG. 5 is a schematic diagram illustrating the operational rule according to a preferred embodiment of the invention. In this embodiment, an image 60 of 4*4 matrix is calculated with a mask 62 of 2*2 matrix to generate an image 64. The calculation in this embodiment is a subtraction calculation. In another embodiment, the calculation can be a calculation including subtraction, addition, multiplication, or other mathematic calculations.

Figure 6A:
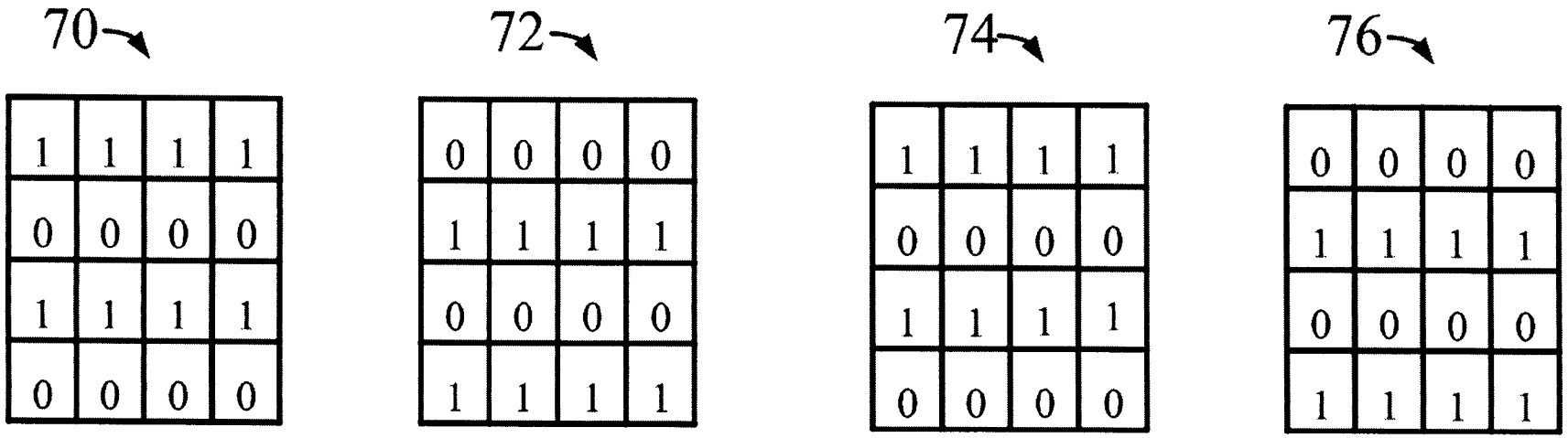
FIG. 6A is a schematic diagram illustrating a set of masks according to an embodiment of the invention.
Figure 6C:
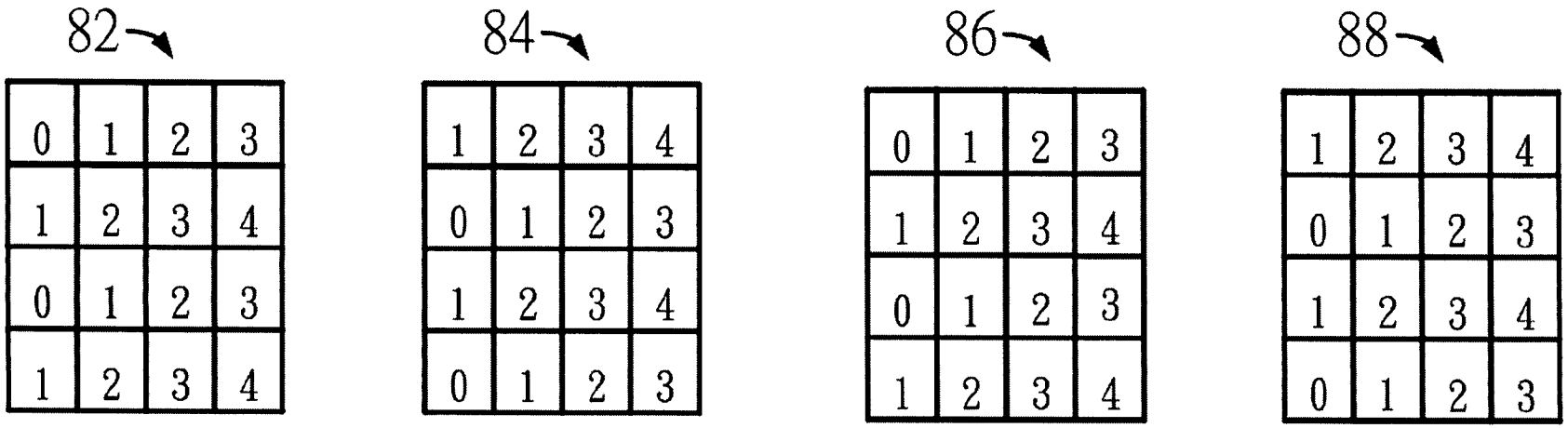
FIG. 6C is a schematic diagram illustrating the matrix of the image shown in FIG. 6B after being calculated with the masks shown in FIG. 6A.
Figure 7C:
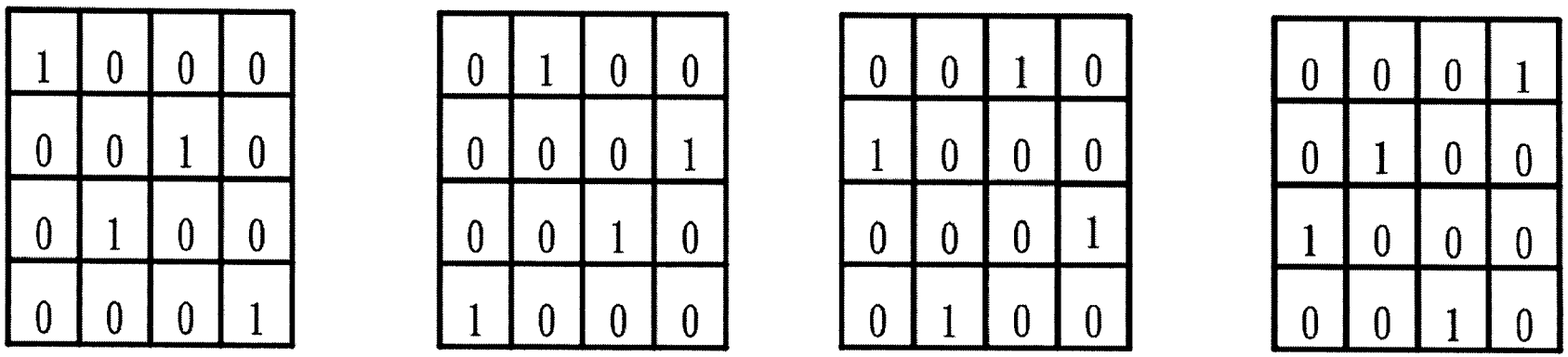
FIG. 7C is a schematic diagram illustrating the masks capable of enabling the brightness of an image 0.75 times the original brightness according to the invention.

Referring to FIG. 6A through FIG. 6D, FIG. 6A is a schematic diagram illustrating a set of masks according to an embodiment of the invention. FIG. 6B is a schematic diagram illustrating an image 78 of 4*4 matrix being calculated with the corresponding matrix 80 according to the invention. FIG. 6C is a schematic diagram illustrating the matrix of the image shown in FIG. 6B after being calculated with the masks shown in FIG. 6A. FIG. 6D is a schematic diagram illustrating the average brightness of each dot of the four fields shown in FIG. 6C.

As shown in FIG. 6A, the four 4*4 matrixes respectively represent the masks of the four fields. The matrixes 70, 72, 74, and 76 represent the matrixes respectively corresponding to the fields I, II, III, and IV. This embodiment can reduce a half of the original brightness of the unit gray level.

As the image 78 of 4*4 matrix (dot A1~dot A16) shown in FIG. 6B, each dot is corresponding to one of the gray levels of the matrix 80. After the image 78 shown in FIG. 6B is calculated with the matrixes 70, 72, 74, and 76 shown in FIG. 6A, the calculation results are as the matrixes 82, 84, 86, and 88 shown in FIG. 6C.

As shown in FIG. 6D, after the image 78 is calculated with the masks of the four fields, the brightness of the image 78 is shown in the matrix 90. After the image 78 is calculated with the masks, the brightness of the dot A1 of the image 78 is equal to (0+1+0+1)/4=0.5, the brightness of the dot A2 of the image 78 is equal to (1+2+1+2)/4=1.5, and so on. When an 8 bits image is calculated with the masks shown in FIG. 6A after a span of time of four or a multiple of four fields, the brightness of the gray levels 0.5, 1.5, 2.5, 3.5, . . . , and 254.5 can be obtained. Accordingly, the brightness of the unit gray level can be reduced to a half of the original brightness, and the brightness between two integral gray levels can be also generated.

There is still a problem in design of the masks. When an image has a big area, high brightness, a big area with the same color, or high contrast, the image will slightly flicker while being displayed. The following describes why the image will slightly flicker while being displayed. As shown in FIG. 6A, the masks utilize an odd and even interlaced calculation and the frequency, 30 Hz, is too low for the odd horizontal line, that is to say the change of the images per second is too slow, so the user would feel the flicker. To avoid the flicker occurring in the continuous images with the same gray levels, the masks shown in FIG. 6A can be corrected.

Referring to FIG. 4 and FIGS. 7A through 7C, FIGS. 7A through 7C are schematic diagrams respectively illustrating the masks according to another embodiment of the invention. The brightness of an image is 0.25 times the original brightness through the mask shown in FIG. 7A. The brightness of an image is 0.5 times the original brightness through the mask shown in FIG. 7B. The brightness of an image is 0.75 times the original brightness through the mask shown in FIG. 7C. In FIG. 4, the masks A, B, and C can be respectively designed as the masks shown in FIG. 7A, FIG. 7B, and FIG. 7C.

Moreover, to avoid the flicker occurring in the same color with lower frequency, the masks respectively corresponding to red, green, and blue can be designed in different kind of mask in one field.

There is a rule for designing the mask. For example, to obtain a mask of 4*4 matrix capable of enabling the brightness of an image 0.75 times the original brightness, 1 should be the element corresponding to the i-th row and the j-th column in one of four 4*4 matrixes, and 0 should be the element corresponding to the i-th row and the j-th column in the rest of the four 4*4 matrixes. To obtain a mask of 4*4 matrix capable of enabling the brightness of an image 0.5 times the original brightness, 1 should be the element corresponding to the i-th row and the j-th column in two of four 4*4 matrixes, and 0 should be the element corresponding to the i-th row and the j-th column in the rest of the four 4*4 matrixes. To obtain a mask of 4*4 matrix capable of enabling the brightness of an image 0.25 times the original brightness, 1 should be the element corresponding to the i-th row and the j-th column in three of four 4*4 matrixes, and 0 should be the element corresponding to the i-th row and the j-th column in the rest of the four 4*4 matrixes. In the above, $1 \leqq i \leqq 4$ and $1 \leqq j \leqq 4$.

The mask can be a 2*2 matrix or a matrix larger than 2*2. However, the variation of the 2*2 matrix is less, so the flicker in an image is easier to occur. Thus, the masks of 4*4 matrix are the preferred embodiment, and a larger matrix is also preferred.

Figure 8:
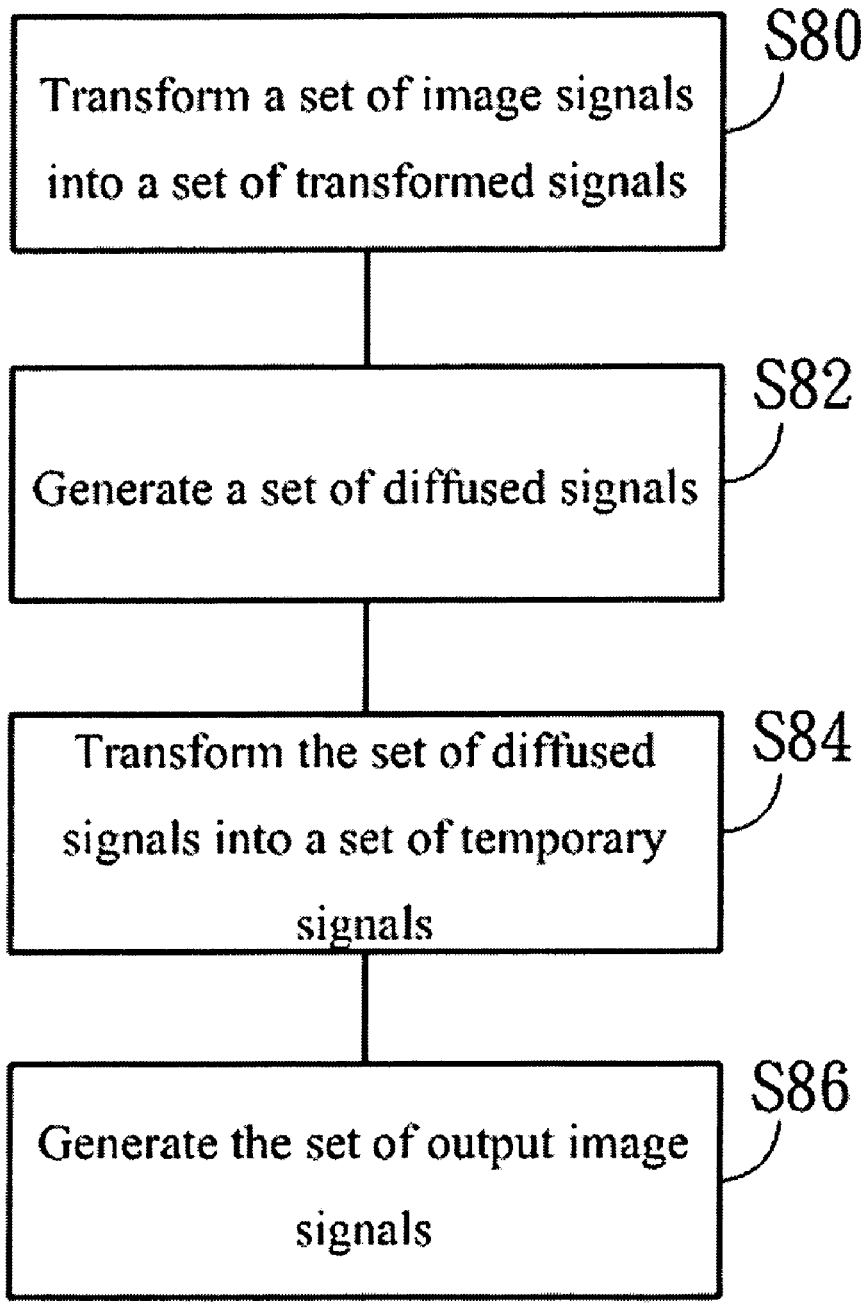
FIG. 8 is a flowchart illustrating the method for increasing the display gray levels according to a preferred embodiment of the invention.

Referring to FIG. 8, FIG. 8 is a flowchart illustrating the method for increasing the display gray levels according to a preferred embodiment of the invention. At start, according to a first predetermined manner, step S80 is performed to transform a set of image signals into a set of transformed signals. Afterwards, step S82 is performed. In step S82, a set of diffused signals is generated according to the set of transformed signals and a judging rule. Step S84 is then performed. In step S84, the set of diffused signals is transformed into a set of temporary signals according to a second predetermined manner. Step S86 is then performed. In step S86, the set of output image signals is generated according to the predetermined operational rule and the set of temporary signals.

The first predetermined manner, the second predetermined manner, the judging rule, the predetermined operational rule all are described as the above-mentioned recitations together with the corresponding drawings, and the related description is neglected.

Referring to FIG. 9A and FIG. 9B, FIG. 9A illustrates the data measured after performing the method the invention. FIG. 9B illustrates the data measured without performing the method of the invention. Comparing FIG. 9A with FIG. 9B, the resolution can be improved by the method the invention. As shown in FIG. 9A, the column of gray shows the gray levels, and the column of Y-with shows the brightness of each gray level measured by performing the method of the invention. As shown in FIG. 9B, the column of Y-without shows the brightness of each gray level measured without performing the method of the invention. According to the data shown in FIG. 9A and FIG. 9B, the method of the invention can obviously increase the display gray levels.

Figure 10:
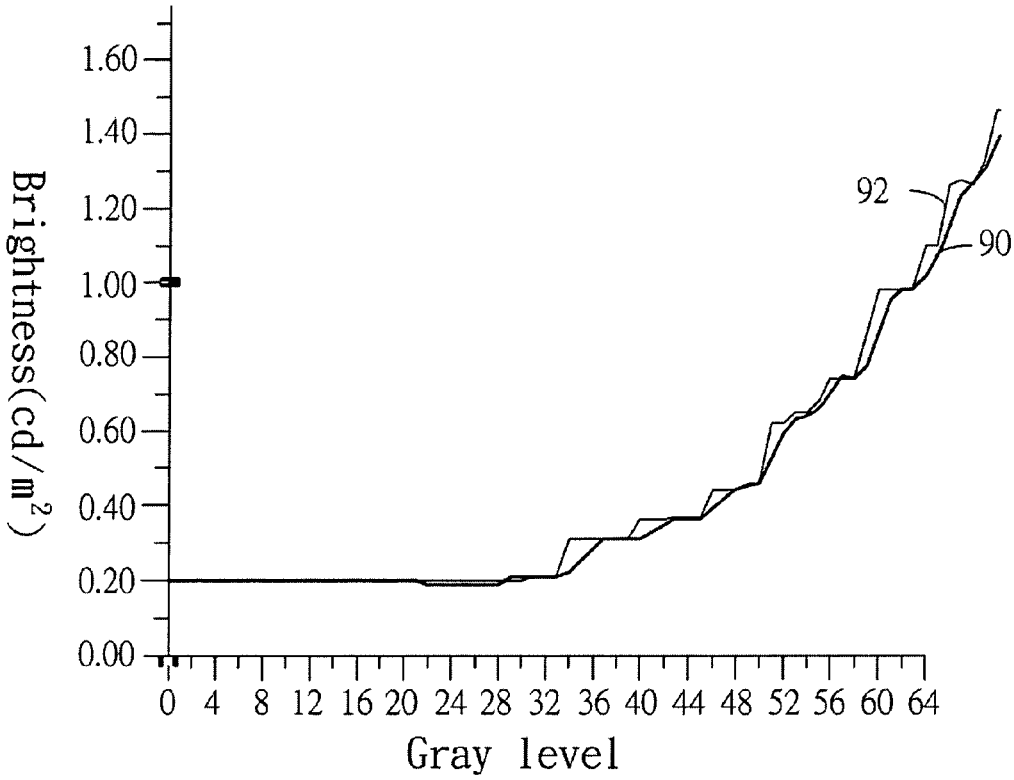
FIG. 10 is a schematic diagram illustrating the relation between the gray levels and the brightness according to the method of the invention.

Referring to FIG. 10, FIG. 10 is a schematic diagram illustrating the relation between the gray levels and the brightness according to the method the invention. As shown in FIG. 10, when the gray level ranges between 0 and 64, the curve 90 shows the relation between the gray level and the brightness after the method the invention is performed. And, the curve 92 shows the relation between the gray level and the brightness without performing the method the invention. That proves, after the method of the invention is performed, the relation between the gray level and the brightness is more linear, and the display device can display the images clearer.

According to the invention, the apparatus and the method for increasing the display gray levels utilize a look up table and a mask to auto-adjust the exceeding brightness of the unit gray level displayed the display device and to eliminate the noise from the displayed image. Therefore, the apparatus and the method of the invention can solve the problems of the prior art and improve the resolution of the image displayed by a display device. The apparatus and the method of the invention can be applied in plasma display panel (PDP), liquid crystal display (LCD), and so on.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An apparatus for increasing the display gray levels, said apparatus comprising:

a signal transformation circuit for transforming a set of image signals into a set of transformed signals according to a first predetermined manner, wherein the first predetermined manner is to utilize a gamma look up table to transform the set of image signals into the set of transformed signals, each of the image signals has L bits, each of the transformed signals has M bits, and M>L;

an error diffusion circuit for receiving the set of transformed signals and generating a set of diffused signals according to a judging rule, wherein the judging rule performs an error diffusion calculation for N high bits and remained (M−N) low bits of each of the transformed signals, so as to generate the set of diffused signals, and each of the diffused signals has N bits; and an operation circuit, according to a second predetermined manner, for transforming the set of diffused signals into a set of temporary signals, and, according to a predetermined operational rule and the set of temporary signals, for generating a set of output image signals, wherein the second predetermined manner is to utilize a first look up table to transform the set of diffused signals into the set of temporary signals, each of the temporary signals has K bits, and N>K, and wherein the predetermined operational rule calculates the set of the temporary signals with a set of masks to generate the set of output image signals, and each of the output image signals has K bits.

2. The apparatus of claim 1, wherein each of the masks comprises P Q*Q matrixes, and Q is greater than or equal to 2.

3. The apparatus of claim 2, wherein a first mask of the masks comprises four 4*4 matrixes, 1 is the element corresponding to the i-th row and the j-th column in three of the four 4*4 matrixes, 0 is the element corresponding to the i-th row and the j-th column in the rest of the four 4*4 matrixes and 1≦i≦4; 1≦j≦4.

4. The apparatus of claim 2, wherein a second mask of the masks comprises four 4*4 matrixes, 1 is the element corresponding to the i-th row and the j-th column in two of the four 4*4 matrixes, 0 is the element corresponding to the i-th row and the j-th column in the rest of the four 4*4 matrixes, and 1≦i≦4; 1≦j≦4.

5. The apparatus of claim 2, wherein a third mask of the masks comprises four 4*4 matrixes, 1 is the element corresponding to the i-th row and the j-th column in one of the four 4*4 matrixes, 0 is the element corresponding to the i-th row and the j-th column in the rest of the four 4*4 matrixes, and 1≦i≦4; 1≦j≦4.

6. A method for increasing the display gray levels, said method comprising the steps of:

(a) transforming a set of image signals into a set of transformed signals according to a first predetermined manner, wherein the first predetermined manner is to utilize a gamma look up table to transform the set of image signals into the set of transformed signals, each of the image signals has L bits, each of the transformed signals has M bits, and M>L;

(b) generating a set of diffused signals according to the set of transformed signals and a judging rule, wherein the judging rule performs an error diffusion calculation for N high bits and remained (M−N) low bits of each of the transformed signals, so as to generate the set of diffused signals, and each of the diffused signals has N bits;

(c)transforming the set of diffused signals into a set of temporary signals according to a second predetermined manner, wherein the second predetermined manner is to utilize a first look up table to transform the set of diffused signals into the set of temporary signals, each of the temporary signals has K bits, and N>K; and (d) generating a set of output image signals according to a predetermined operational rule and the set of temporary signals, wherein the predetermined operational rule calculates the set of the temporary signals with a set of masks to generate the set of output image signals, and each of the output image signals has K bits.

7. The method of claim 6, wherein each of the masks comprises P Q*Q matrixes, and Q is greater than or equal to 2.

8. The method of claim 7, wherein a first mask of the masks comprises four 4*4 matrixes, 1 is the element corresponding to the i-th row and the j-th column in three of the four 4*4 matrixes, 0 is the element corresponding to the i-th row and the j-th column in the rest of the four 4*4 matrixes, and 1≦i≦4; 1≦j≦4.

9. The method of claim 7, wherein a second mask of the masks comprises four 4*4 matrixes, 1 is the element corresponding to the i-th row and the j-th column in two of the four 4*4 matrixes, 0 is the element corresponding to the i-th row and the j-th column in the rest of the four 4*4 matrixes, and 1≦i≦4; 1≦j≦4.

10. The method of claim 7, wherein a third mask of the masks comprises four 4*4 matrixes, 1 is the element corresponding to the i-th row and the j-th column in one of the four 4*4 matrixes, 0 is the element corresponding to the i-th row and the j-th column in the rest of the four 4*4 matrixes, and 1≦i≦4; 1≦j≦4.

* * * * *